US005209327A

United States Patent [19]

Wright et al.

[11] Patent Number: 5,209,327

[45] Date of Patent: May 11, 1993

[54] WHEELED ARTICLE OF LUGGAGE

[75] Inventors: Richard A. Wright; Robert A. Wright; Melvin Repscher, all of Taylorville, Ill.

[73] Assignee: New Specialized Products, Inc., Taylorville, Ill.

[21] Appl. No.: 788,337

[22] Filed: Nov. 6, 1991

[51] Int. Cl.[5] ..... A45C 5/14

[52] U.S. Cl. ..... 190/18 A; 190/127; 206/279; 206/280; 206/287

[58] Field of Search ..... 190/18 A, 127; 206/279, 206/280, 287, 289

[56] References Cited

U.S. PATENT DOCUMENTS

| | | | |
|---|---|---|---|
| 1,099,933 | 6/1914 | Pohrer . | |
| 1,822,893 | 9/1931 | Kapolkin . | |
| 2,086,895 | 7/1937 | Cart | 190/127 |
| 2,228,066 | 1/1941 | Tashbook | 280/55 |
| 2,313,884 | 3/1943 | Mattoon | 190/18 A |
| 2,392,926 | 1/1946 | Kelly | 190/39 |
| 2,463,391 | 1/1949 | Kanaley | 190/18 |
| 2,596,578 | 5/1952 | McIntyre et al. | 280/38 |
| 2,754,945 | 7/1956 | Kish, Jr. | 190/127 |
| 2,755,896 | 7/1956 | Breglia | 190/127 |
| 2,841,257 | 7/1958 | Dallas | 206/289 |
| 4,030,768 | 6/1977 | Lugash | 280/47 |
| 4,062,429 | 12/1977 | Tabor et al. | 190/18 A |
| 4,134,479 | 1/1979 | Crider, Jr. | 206/287 |
| 4,354,583 | 10/1982 | Walker | 190/18 A |
| 4,383,141 | 5/1983 | Walker | 190/18 A |
| 4,502,576 | 3/1985 | Reardon | 190/127 |

FOREIGN PATENT DOCUMENTS

| | | | |
|---|---|---|---|
| 132016 | 1/1985 | European Pat. Off. | 190/18 A |

*Primary Examiner*—Gary E. Elkins

*Attorney, Agent, or Firm*—Senniger, Powers, Leavitt & Roedel

[57] ABSTRACT

A wheeled article of luggage comprising a wheeled frame and a garment bag mounted on the frame. The frame comprises a generally rectangular base, one of the long edges of the base constituting the front edge of the base and the other long edge constituting the back edge of the base, and a post extending up from the base closely adjacent the back edge of the base generally at the center of length of the base, for hanging garments on hangers in front of the post. The bag has a bottom, front, back, sides and a top. The bag bottom is of a generally rectangular shape corresponding to the shape of the base and is secured to the base. The front of the bag extends up from the front edge of the base and is openable for access to the interior of the bag. A bracket is cantilevered forward from the upper end of the post, carrying a rod. A handle is attached to the bracket extending on the outside of the top of the bag arranged for pushing the wheeled bag in direction lengthwise of the base.

8 Claims, 3 Drawing Sheets

WHEELED ARTICLE OF LUGGAGE

BRIEF SUMMARY OF THE INVENTION

The present invention relates generally to luggage and more particularly to a wheeled garment bag.

The invention is in the same field as the article of luggage shown in U.S. Pat. No. 4,030,768 and involves improvements thereover particularly for facilitating access to the bag for hanging garments on hangers therein while providing a sturdy, economical wheeled construction which is readily assembled.

In general, a wheeled article of luggage constructed according to the principles of the present invention comprises a wheeled frame and a garment bag mounted on the frame. The frame comprises a generally rectangular base, one of the long edges of the base constituting the front edge of the base and the other long edge constituting the back edge of the base. Wheels are provided at the bottom of the base and a post extends up from the base closely adjacent the back edge of the base generally at the center of length of the base. Means extending forward from the post at the upper end of the post is further provided for hanging garments on hangers in the front of the post. The bag has a bottom, front, back, sides and a top. The bag bottom is of a generally rectangular shape corresponding to the shape of the base and is secured to the base. The front of the bag extends up from the front edge of the base and is openable for access to the interior of the bag for hanging garments on hangers in the bag and for removal of garments hung in the bag. The back of the bag extends up from the back edge of the base in back of the post on the outside of the post contiguous to the post. The sides of the bag extend up from the ends of the base, and the top of the bag extends over the hanging means at the upper end of the post.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 2:
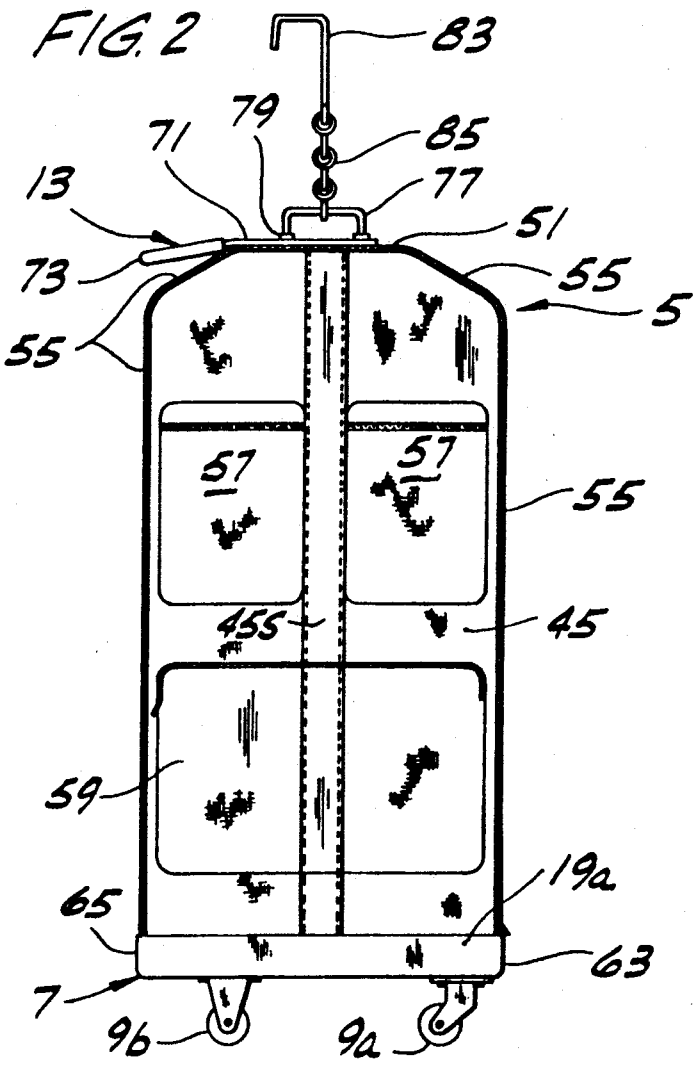
FIG. 2 is a rear elevation of the bag.
Figure 1:
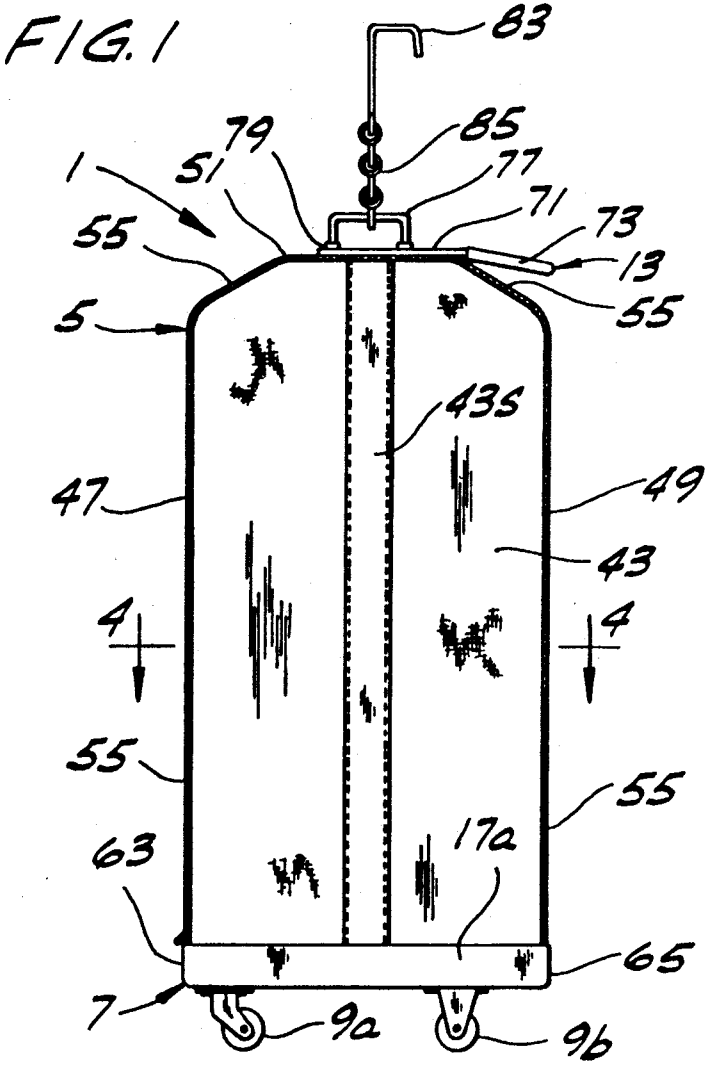
FIG. 1 is a front elevation of a wheeled garment bag of the present invention.

Referring now to the drawings, there is generally indicated at 1 a wheeled article of luggage, more particularly a wheeled garment bag, of the present invention the entire interior of which is generally readily accessible so that a person may readily hang garments on hangers within its interior and remove garments hung therein. It comprises a wheeled frame 3 and a garment bag 5 mounted on the frame 3. The latter comprises a generally rectangular base 7 having wheels 9*a* and 9*b* attached to the bottom thereof. A post 11 extends up from base 7. Means 13 for hanging garments on hangers extends forward from the upper end of post 11. A handle 15, fixedly attached to hanging means 13, is provided for pushing the bag 1.

Turning to FIGS. 1-3 and 5, rectangular base 7 is shown as disposed in a horizontal plane. One of the long edges of the base constitutes its front edge 17 and the other long edge constitutes its back edge 19. Post 11 is mounted closely adjacent the back edge 19 of base 7 and extends upward in a vertical direction. The post 11 is mounted generally at the center of length of base 7. It is made from square tubing, secured on the base with one of the flat sides of the square tube parallel to back edge 19. Securement may be in any suitable manner, e.g. welding, for fixedly attaching post at its lower end to base 7. Braces 21 and 23 may be provided for additional support of the post 11 on base 7, brace 21 being positioned in the vertical plane of the post 11 transverse to the bottom of frame 3 and brace 23 positioned in the vertical plane of the post 11 lengthwise of the base. It is to be understood however, that other means may be incorporated to provide additional support of post 11 on base 7.

Figure 3:
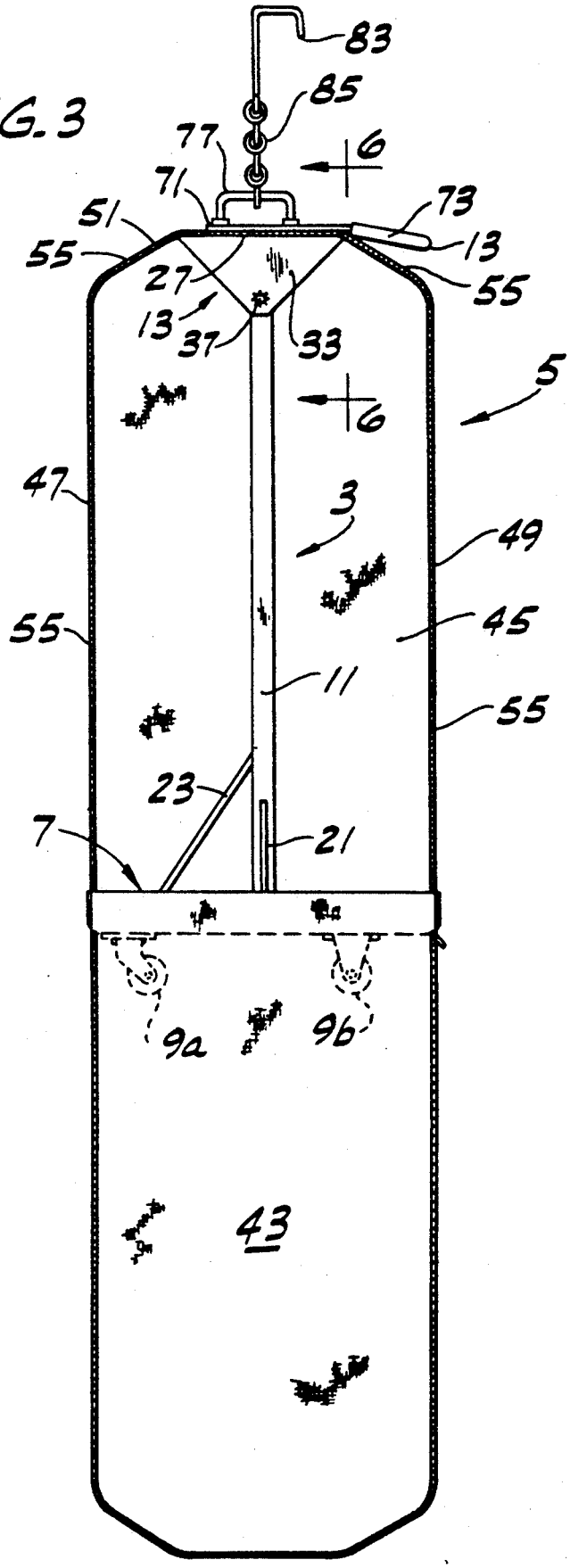
FIG. 3 is a front elevation of the bag showing the front open.
Figure 6:
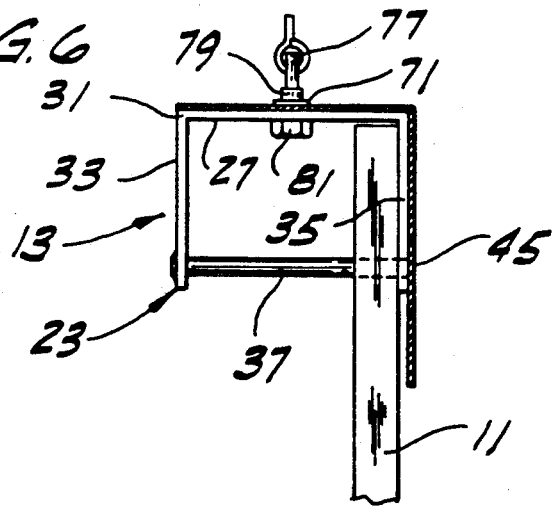
FIG. 6 is a cross-section taken on line 6—6 of FIG. 3.

The means 13 for hanging garments comprises a bracket 25 cantilevered forward from the upper end of post 11 (See FIGS. 3 and 6). This bracket comprises a rectangular plate 27, one of the short edges of the plate constituting the back edge 29 of the plate and the other short edge constituting the front edge 31 of the plate. Plate 27 is disposed in a horizontal plane and is fixedly attached by spot welding or other like fastening means to post 11 adjacent the back edge 29 generally at the center length of the edge. Extending down from edges 29, 31 of plate 27 are two inverted triangular end members 33, 35. These are integral with plate 27, being formed by bending them down from a unitary piece of material. End member 35, at the back edge 29, engages flatwise against the flat back surface of the post 11 and is securely attached thereto, thereby providing extra support for the bracket 25. A rod 37 extends in front-to-rear direction between the two inverted triangular members 33, 35, passing through an opening in the past 11 located near the upper end of the post. Rod 37 is securely mounted in members 33, 35 near the apex of each inverted triangle as by spot welding or in other suitable manner and is adapted for hanging thereon of garments on hangers.

The garment bag 5 has a bottom 41, front 43, back 45, sides 47, 49 and a top 51. It may be made of any suitable fabric. The bottom 41 of bag 5 is of generally rectangular shape corresponding to the shape of base 7 and is secured to the base. The front 43 is constituted by a panel extending up from the front edge 17 of base 7 and is openable for access to the interior of the bag for hanging garments on hangers in the bag (the hangers being hung on the rod 37) and for removal of garments hung in the bag. A seam in the front 43 is indicated at 43*s*. The front 43 of the bag is in effect hinged to the front edge of the bottom 41 of the bag and is adapted to be secured in closed position (closing the front of the bag) by slide fastener means 55 extending all along the sides and top of the front and the front edges of the sides and top of the bag. By unzipping the front 43, one may access the interior of bag and by zipping up the front one may close the interior so as to protect garments hung there within. The back 45 of bag 5 extends up from the back edge 19 of base 7 in back of post 11 on the outside of the post 11 contiguous to the post. A seam in the back wall is indicated at 45*s*. Provided on the exterior of back 45 are zippered pockets for storing loose articles of clothing and the like. As shown, there are two smaller pockets 57 and one large pocket 59, but it is to be understood that different pocket arrangements may be provided. The top 51 of the bag 5 extends over plate portion 27 of the bracket 25 at the upper end of post 11.

Figure 4:
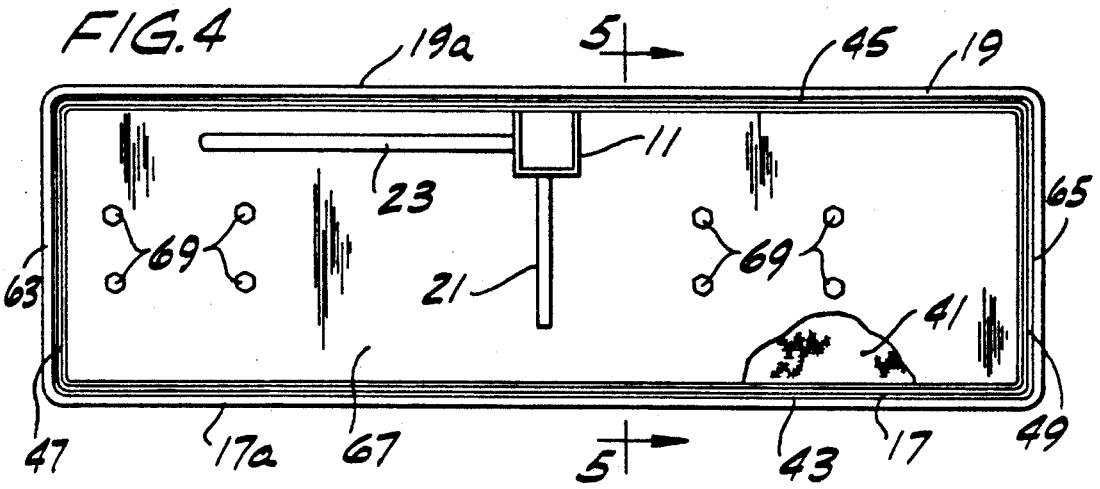
FIG. 4 is a cross-section taken on line 4—4 of FIG. 1.
Figure 5:
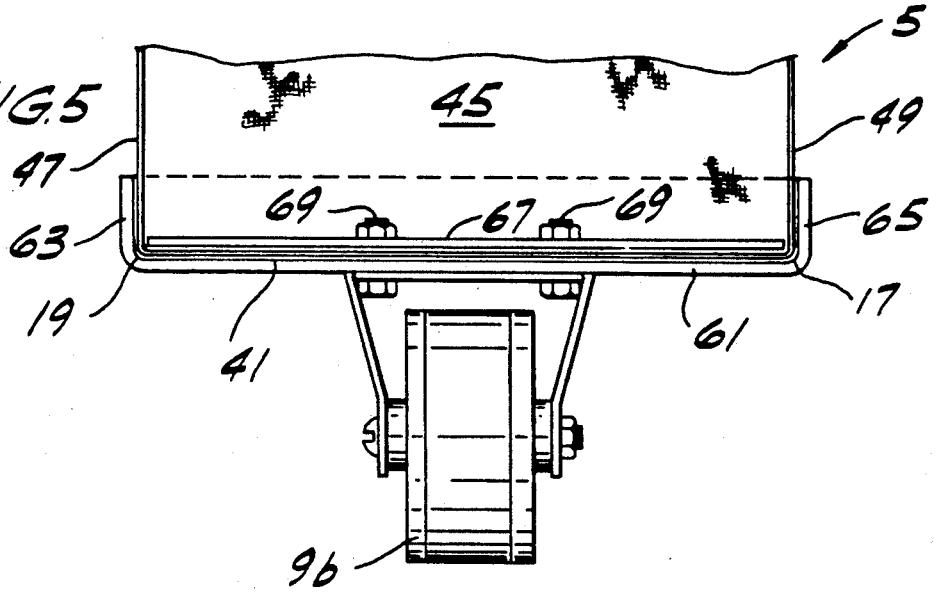
FIG. 5 is a cross-section taken on line 5—5 of FIG. 4.

The bottom 41 of bag 5 is secured to base 7 particularly as shown in FIGS. 4 and 5, the base comprising a bottom plate 61 having upwardly extending flanges 17*a* and 19*a* at both the front and back edges 17, 19 and at ends 63, 65, and a top plate 67 which fits within the flanges. The bottom 41 of bag 5 lies flat in a horizontal plane on the bottom plate 61 and the top plate 67 overlies the bottom 41, i.e. the bag bottom 41 is sandwiched between the plates 61, 67, thereby effectively securing the garment bag 5 in place in the base. Fasteners 69 extend through openings in the bag bottom 41 and base plates 61, 67 to secure the plates together, and to secure the bag bottom 41 to base 7. Fasteners 69 are bolt and nut fasteners and are the same fasteners as used to secure wheels 9*a* and 9*b* to base 7. Post 11 extends up from and is fixedly secured to top plate 67.

The top 51 of the bag extends over the plate portion 27 of the bracket 25 and is secured thereto sandwiched between portion 27 and the shank 71 of the handle 15. The handle comprises a length of tubing of circular cross section a portion of which is flattened to form the shank 71. A sleeve 73 of cushioning material is applied to the unflattened part of the handle. The shank of the handle is secured to the plate portion 27 of the bracket 25 over the top 51 of the garment bag by means of a U-bolt 77 having its legs extending down through aligned openings in the shank 71, the top 51 of the bag and the plate portion 27 of the bracket 25, with heads 79 on the U-bolt legs engaging the shank and nuts 81 threaded up on the lower ends of the legs against the bottom of the plate portion 27. A hook 83 on a chain 85 may also be included for hanging up the bag, the chain being attached to the U-bolt.

Wheels 9*a* and 9*b* enable the bag to be transported along a surface. Wheel 9*a* is a castered wheel for steering the bag. It is mounted on the bottom of the bottom base plate 61 adjacent end 63 of base 7 constituting its forward end with respect to the direction in which the bag is wheeled, being castered to swivel about a vertical axis. The second wheel 9*b* is mounted on the bottom of base plate 61 adjacent rearward end 65. Both wheels are mounted by the same fasteners 69 through the same openings that are used to secure the bottom 41 of bag 5 between plates 61, 67. Handle 13 extends towards the rearward end 65, thus dictating the direction in which the bag should be pushed.

In view of the above, it will be seen that the several objects of the invention are achieved and other advantageous results attained.

As various changes could be made in the above constructions without departing from the scope of the invention, it is intended that all matter contained in the above description as shown in the accompanying drawing shall be interpreted as illustrative and not in a limiting sense.

What is claimed is:

1. A wheeled article of luggage comprising a wheeled frame and a garment bag mounted on the frame, the frame comprising a generally rectangular base having two long edges, two ends, a top and a bottom, one of the long edges of the base constituting a front edge of the base and the other long edge constituting a back edge of the base, wheels at the bottom of the base, the base having a center of length, a post extending up from the base closely adjacent the back edge of the base generally at the center of length of the base, said post having an upper end, means extending forward from the post at the upper end of the post for hanging of garments on hangers in front of the post, the bag having a bottom, front, back, sides and a top, the bag bottom being of generally rectangular shape corresponding to the shape of the base and secured to the base, the bag having an interior, the front of the bag extending up from the front edge of the base and being openable for access to the interior of the bag for hanging garments on hangers in the bag and for removal of garments hung in the bag; the back of the bag extending up from the back edge of the base in back of the post outside the post contiguous to the post, the sides of the bag extending up from the ends of the base, and the top of the bag extending over said garment-hanging means at the upper end of the post, and a handle attached to said garment-hanging means located outside of the top of the bag and arranged for pushing the article in direction lengthwise of the base.

2. A wheeled article of luggage as set forth in claim 1 wherein the base comprises a bottom plate having upwardly extending flanges at both the front and back edges and at the ends thereof, and a top plate which fits within the flanges, the bottom of the bag lying flat on the bottom plate, the top plate overlying the bottom of the bag, fasteners extending through the top plate, the bag bottom and the bottom plate for securing the bag bottom in place sandwiched between the plates, the post extending up from the top plate.

3. A wheeled article of luggage as set forth in claim 2 wherein the bottom base plate has a bottom, and said article of luggage has a castered wheel mounted on the bottom of the bottom base plate adjacent one of said ends of the base constituting a forward end with respect to the said direction in which the article of luggage is wheeled for swivelling of the castered wheel about a vertical axis, and a second wheel mounted on the bottom base plate adjacent the other of said ends of the base, the handle extending in the opposite direction.

4. A wheeled article of luggage as set forth in claim 3, the post extending up in a first vertical plane transverse to said base, and in a second vertical plane lengthwise of said base, having two braces for the post extending between the post and the top base plate, one brace in said first vertical plane and the second brace in said second vertical plane of the post.

5. A wheeled article of luggage as set forth in claim 1 wherein the hanging means for hanging of garments on hangers comprises a hanging bracket comprising a rectangular plate having two long and two short edges, one of the short edges of the bracket plate constituting a back edge of the bracket plate and the other short edge constituting a front edge of the bracket plate, said back edge having a center of length, said bracket plate being fixedly attached to the post adjacent the back edge generally at the said center of length of said back edge, flanges extending down from the front and back edges of said plate and a rod extending between said flanges for hanging of garments on hangers.

6. A wheeled article of luggage as set forth in claim 5 wherein the top of said garment bag extends over said bracket plate, and having means for fastening the top of the bag to said bracket plate.

7. A wheeled article of luggage as set forth in claim 6 wherein said fastening means comprises a flattened portion of said handle, the engaging said bracket plate with said bag bottom disposed between the flattened portion and the plate, a U-shaped fastener extends through the flattened portion of said handle, the bag top and said plate for securing the bag in place sandwiched between said flattened portion and said plate, the post extending down from the plate.

8. A wheeled article of luggage as set forth in claim 1 wherein the front of the bag has sides and a top, and the sides and top of the bag have front edges, and said bag has slide fastener means around the sides and top of the front of the bag and the front edges of the sides and top of the bag for fastening the front of the bag to the sides and top of the bag.

* * * * *